United States Patent [19]

Spring

[11] 4,289,254

[45] Sep. 15, 1981

[54] ARTICLE DISPENSER WITH CAM ACTUATED GATE

[75] Inventor: Carl E. Spring, La Crosse, Wis.

[73] Assignee: La Crosse Cooler Company, La Crosse, Wis.

[21] Appl. No.: 97,270

[22] Filed: Nov. 26, 1979

[51] Int. Cl.[3] ..... G07F 11/34

[52] U.S. Cl. ..... 221/295; 221/298

[58] Field of Search ..... 221/298, 251, 295, 297

[56] References Cited

U.S. PATENT DOCUMENTS

| | | | |
|---|---|---|---|
| 2,260,643 | 10/1941 | Rosan | 221/295 X |
| 2,974,828 | 3/1961 | Matteson | 221/297 X |
| 2,993,623 | 7/1961 | Bendot | 221/298 |
| 3,189,217 | 6/1965 | Cease | 221/298 X |
| 3,348,733 | 10/1967 | Johnson | 221/298 |
| 3,464,589 | 9/1969 | Oden | 221/295 |
| 3,602,403 | 8/1971 | Klem | 221/298 X |

*Primary Examiner*—F. J. Bartuska

[57] ABSTRACT

Disclosed herein is a can dispensing mechanism for releasing containers from a row of containers stored in an automatic vending machine. A slide driven by a motor or solenoid operates a can control gate and a row gate which are in the form of L-shaped levers. The slide is provided with gate position control surfaces including an inclined ramp or cam surface, an offset surface and an end surface. The control surfaces change the position of the gates about their pivotal connections during movement of the slide through the vend cycle. The gates are gravity biased to the open position and move into can blocking positions under influence of the control surfaces on the slide. Springs and complicated linkages are eliminated to provide a reliable, inexpensive, maintenance free unit.

5 Claims, 6 Drawing Figures

ARTICLE DISPENSER WITH CAM ACTUATED GATE

BACKGROUND OF THE INVENTION

U.S. Pat. Nos. 2,260,643; 3,348,733; and 3,464,589 are illustrative of can vending machines in which the leading can in the row is separated and dispensed from the row by solenoids or motors which operate release gates through linkages. The present invention provides a relatively simple and hence inexpensive arrangement in which the gates are not mechanically connected to the motor through a linkage nor operated by springs.

SUMMARY OF THE INVENTION

The invention provides a can release machanism in a gravity discharge container storage system in which separate gates control release of the leading can and hold back the row of cans during release or separation of the leading can. The gates are in the form of L-shaped levers pivotally connected at one end to a support frame and with rollers adjacent the bight or juncture of the legs of the levers. The rollers travel on control surfaces on a slide which influence the position of the gates during the standby and vend cycle. The slide can be operated by either a solenoid or a motor and crank assembly. The use of cam controlled gates without springs or links provides a positive and maintenance free operation with a minimum expense for components.

Further objects, advantages and features of the invention will become apparent from the disclosure.

DESCRIPTION OF THE PREFERRED EMBODIMENT

Figure 1:
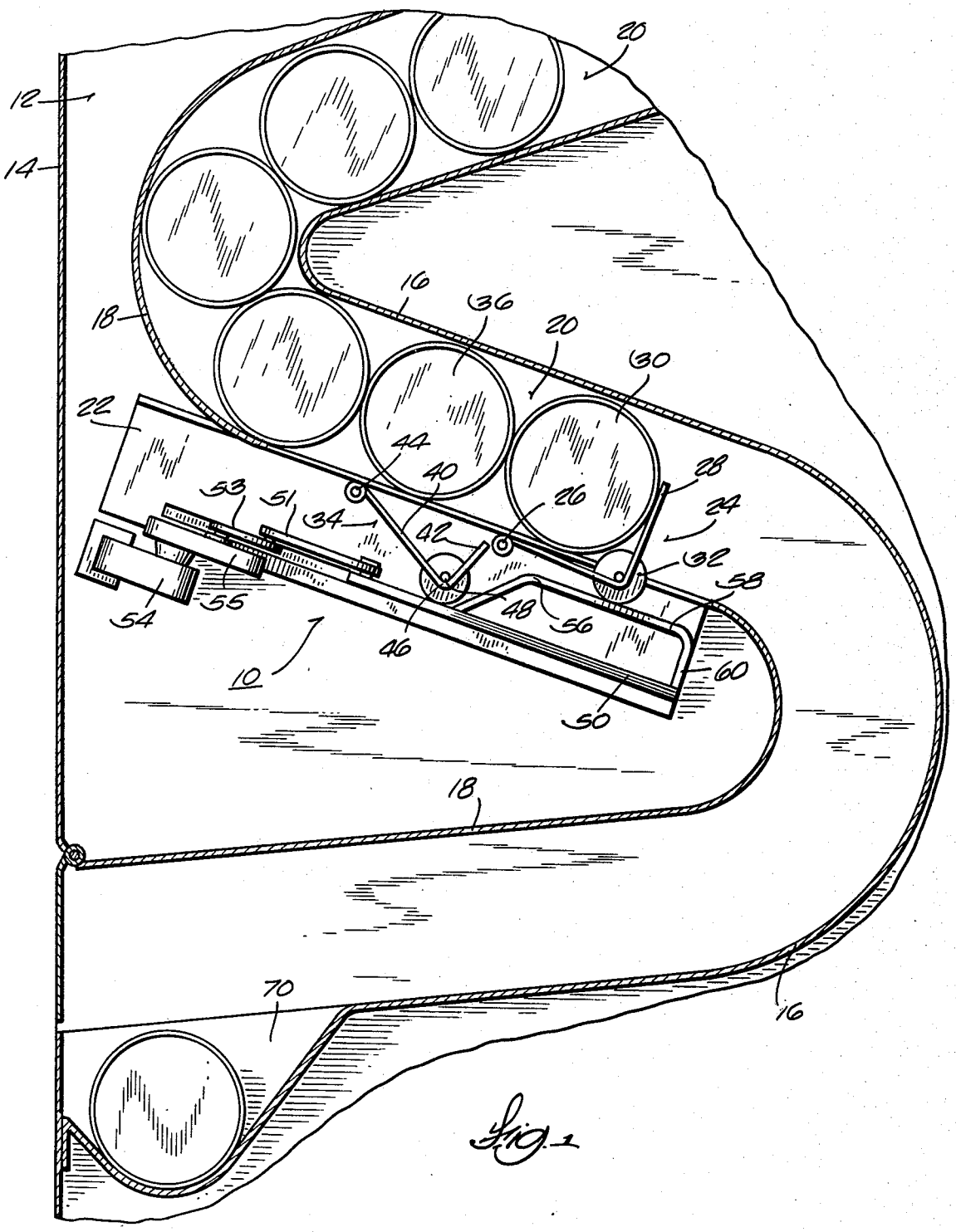
FIG. 1 is a fragmentary side elevational view showing the can dispensing mechanism of the invention associated with a serpentine storage rack and showing the gates in the standby position.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

The can dispensing mechanism 10 of the invention is shown in an automatic can dispenser 12 having a frame 14 provided with guide tracks 16 and 18 which support a stack or row 20 of cans. Typically automatic vending machines have a plurality of separate stacks or rows of cans of different flavors in a single machine. Accordingly, a can or container release machanism 10 would be provided for each row of cans.

When the proper coins have been placed in the machine and the selection button pushed, an electrical circuit (not shown) is energized to provide current to the can release mechanism during the dispense or vend cycle.

The can release machanism of the invention 10 is mounted on a bracket 22 which is fastened to the frame 14. The mechanism includes a leading can or foremost can gate 24 which is generally L-shaped, with one leg pivotally connected by a pivot or shaft 26 to the bracket 22. In FIG. 1, the gate 24 is shown in the standby position with the free leg 28 in contact with the leading or foremost can 30 in the row 20. The gate 24 is provided with a roller 32 which is rotatably supported by a shaft at the juncture of the two legs of the gate. The roller 32 cooperates with gate control surfaces, as subsequently described.

The dispensing mechanism also includes a gate 34 for holding back the row 20 during the vend cycle when can 30 is discharged and for releasing can 36 for movement into the standby position occupied by can 30. The gate 34 includes a leg 40 which is interconnected to a transversely extending leg 42. Leg 40 is pivotally connected to the bracket 22 by a pivot 44. A roller 46 is rotatably connected and supported on the gate by a shaft 48 fastened to the juncture of the legs 40 and 42.

The movement of the gates is controlled by a slide 50. The slide can be supported on bracket 22 by laterally outwardly extending wings 47 which extend into slots 43 in the opposed walls 45 of the bracket 22. Alternate arrangements can be employed for supporting and guiding the slide. In FIG. 1, the slide 50 is connected to a motor 54 by a link 51, crank 53 and speed reducer 55. These parts move the slide between the FIG. 1 standby position to the FIG. 3 vend position.

Figure 2:
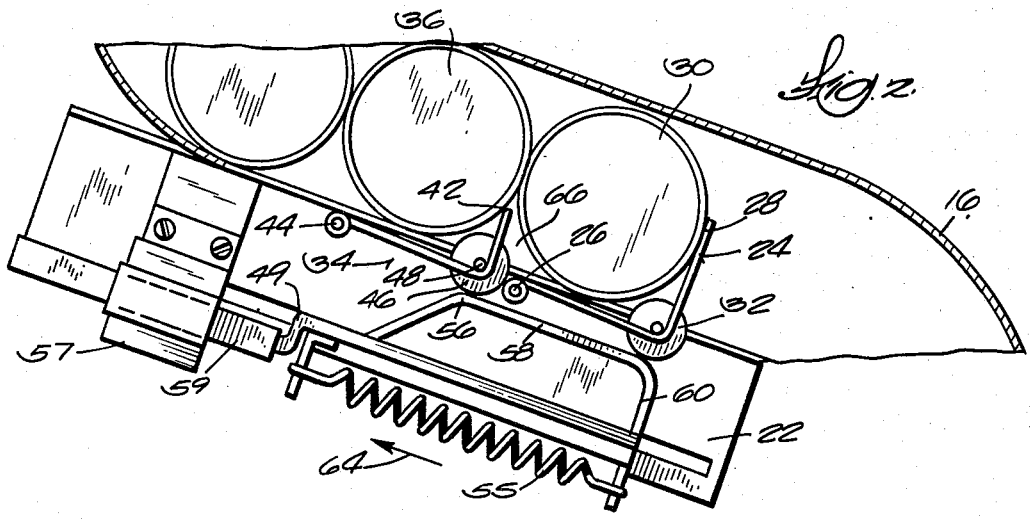
FIG. 2 is a view similar to FIG. 1 of a modified embodiment showing the gates in an intermediate position.
Figure 3:
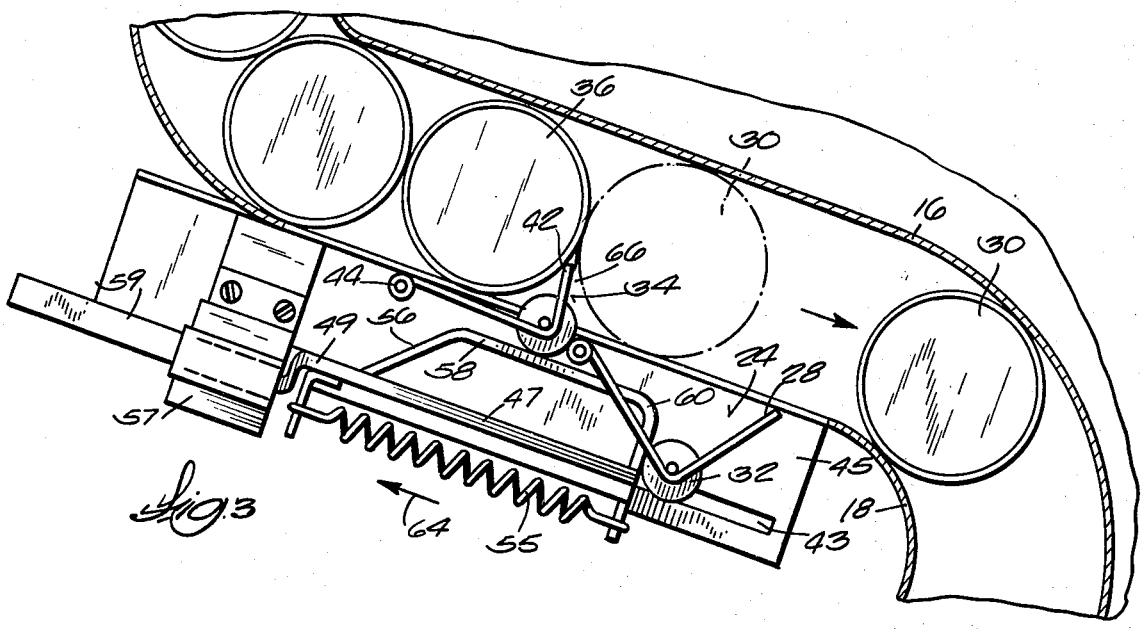
FIG. 3 is a view similar to FIG. 2 of another modified embodiment showing the gates in the vend position.

In FIGS. 2 and 3, a solenoid 67 is employed in lieu of the motor 54. The solenoid 67 has an armature 69 connected to the slide. A spring 55 biases the slide to the FIG. 1 standby position. The slide includes a first surface 49, ramp or inclined surface 56, an offset surface 58 and an end surface 60. All of these surfaces influence the position of the gates 24 and 34.

In operation, in FIG. 1 the gate 24 is in contact with the leading can 30 in the row 20. Upon actuation of the dispense mechanism and the energization of the motor 54 or solenoid 57, the slide 50 moves through the intermediate position (FIG. 2) in the direction of arrow 64, and the inclined surface or ramp 56 in cooperation with roller 46 cams the gate 34 upwardly into a position 66 between cans 30 and 36. The gate 24 continues to remain in an obstructing position with respect to the cam 30 until the gate 34 is in a blocking position, as illustrated in FIG. 2.

Figure 4:
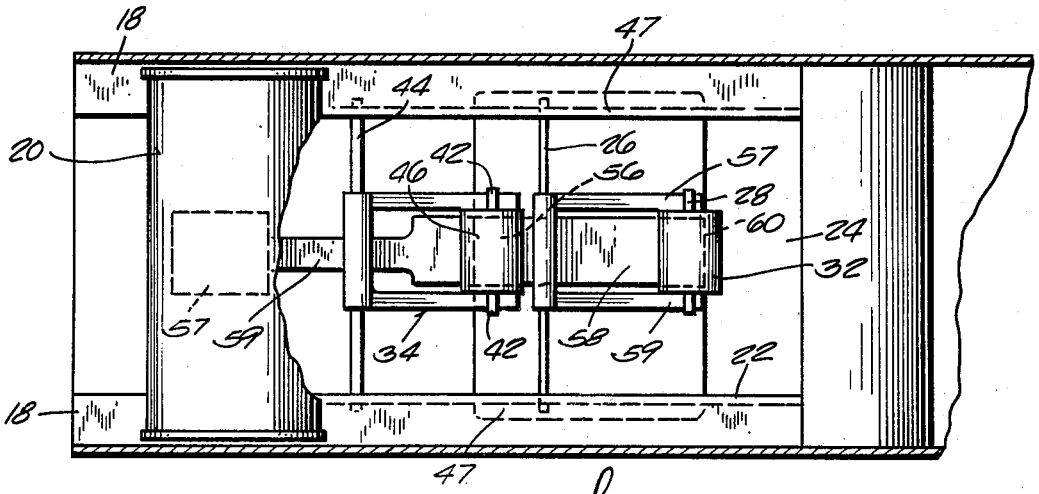
FIG. 4 is a top view of the apparatus shown in FIG. 3.

FIG. 3 illustrates the vend position of the gates in which continued movement of the slide in the direction of arrow 64 causes the roller 32 to fall from the offset surface 58 under its own weight and the gravity of the can 30 to the displaced position with the roller engaged against the surface 60. The bifurcated nature of the legs 57, 59 of the gate, as shown in FIG. 4, permits the end 61 of the juncture of surfaces 60 and 58 to interfit between the spaced leg portions 57, 59. The can 30 is released and rolls down the chute to the access pocket 70 illustrated in FIG. 1. The energization of the solenoid is timed so that sufficient time elapses for can 30 to roll past the top of the gate. Upon de-energization of the solenoid 54, the spring returns the slide to the FIG. 1 position and the roller 32 climbs up to the surface 58, the gate 34 drops down to the FIG. 1 position, allowing the can 36 to escape to the standby position which is the leading position formerly occupied by can 30.

Figure 5:
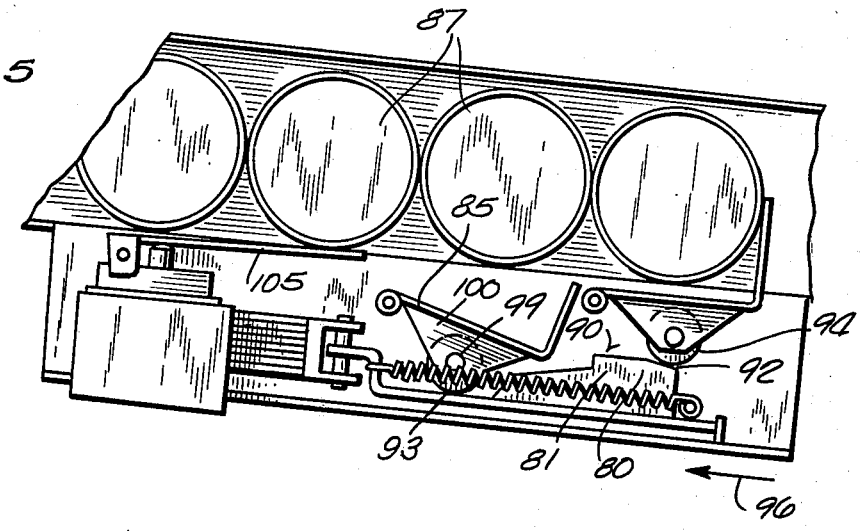
FIG. 5 is a diagrammatic side elevational view of a modified embodiment of the invention with the leading container gate in the standby position.
Figure 6:
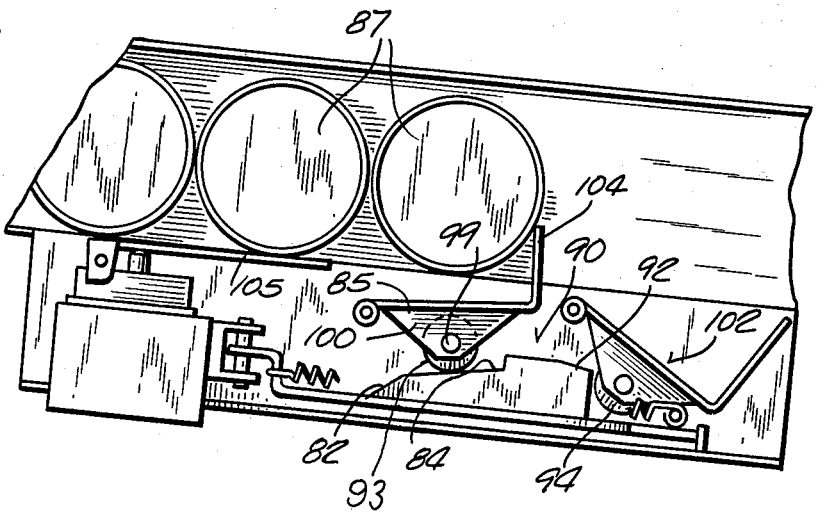
FIG. 6 is a view similar to FIG. 5 with the leading container gate in the vent position.

FIGS. 5 and 6 show a modified embodiment in which the slide 80 has a first surface 82 which is transverse to the axis of movement of the slide and transverse to a second surface 84. The surface 82 provides a fast rise for the row gate 85 to catch the can 87 prior to any appreciable movement thereof. The gate control surface 90 has an angularly related surface 92 which is inclined downstream in the direction of the path of movement of the containers and cooperates with roller 94 to provide a cam action to assist retraction of the slide 81 in the direction of the arrow 96, which is particularly appropriate for low voltage solenoid operation.

The rollers 93, 94 are rotatably supported on axles 99 carried by tabs or ears 100 connected to the gate levers 102, 104. FIGS. 5 and 6 also disclose the paddle 105 for the sold out switch. The paddle is biased upwardly to actuate the switch when a can is not present to depress the paddle.

What is claimed is:

1. In a coin operated vending machine having a frame, a magazine supported on said frame with a sloping guide surface for supporting and delivering by gravity the leading container from a row of containers, the improvement comprising a leading container gate, means for supporting said leading container gate on said frame for movement between an advanced leading container blocking position and movement to a retracted leading container release position, a row gate, means for supporting said row gate on said frame for movement between a row blocking position and a row advance position, means for operating said leading container gate and row gate to separate and release the leading container from the row and hold back the row of containers during separation, said means including a slide having first, second and third gate position controlling surfaces, said second surface being inclined and transverse with respect to said first surface and the direction of reciprocating movement of the slide and said third surface being offset from the axis of reciprocation, said first surface being at a steeper angle than said second surface to provide a fast rise time for the row gate to catch a can prior to movement thereof and wherein said third surface has a portion inclined forwardly in the direction of the path of movement of the container to urge said slide to the retracted position and toward the longitudinal axis of the slide, and means for supporting the slide on said frame for reciprocating movement between an extended and retracted position, and motor means for reciprocating said slide in a standby and vend cycle whereby said leading container gate is supported on said third surface during standby and said row gate is supported on said first surface and, upon energization of the motor means, said row gate will move into a row blocking position upon lateral movement of said slide toward said row gate as said inclined surface coacts with said gate and then said leading container gate dropping from said third surface portion by gravity and the weight of the container when the slide reaches the vend position to remove the gate from the path of the first container and upon release of the container the slide returning to the standby position.

2. The improvement of claim 1 wherein said gates comprise generally L-shaped levers with one end pivotally connected to said frame and including rollers rotatably supported on said levers and in rolling contact with said control surfaces.

3. The improvement of claim 2 wherein said leading gate lever is bifurcated and receives the juncture of said offset and end control surfaces when said leading gate is in the vend position.

4. The improvement of claim 1 wherein said motor means comprises a solenoid.

5. The improvement of claim 1 wherein said motor means includes an electric motor, gear reduction and a crank and link assembly.

* * * * *